US008783559B2

(12) United States Patent
Lees et al.

(10) Patent No.: US 8,783,559 B2
(45) Date of Patent: Jul. 22, 2014

(54) STATE DETECTION

(75) Inventors: Stewart D. Lees, Fife (GB); Ross Johnston, Fife (GB)

(73) Assignee: NCR Corporation, Duluth, GA (US)

( * ) Notice: Subject to any disclaimer, the term of this patent is extended or adjusted under 35 U.S.C. 154(b) by 172 days.

(21) Appl. No.: 13/454,797

(22) Filed: Apr. 24, 2012

(65) Prior Publication Data

US 2013/0277382 A1 Oct. 24, 2013

(51) Int. Cl.

| | |
|---|---|
| ***G06Q 40/00*** | (2012.01) |
| ***G07D 11/00*** | (2006.01) |
| ***G07F 19/00*** | (2006.01) |

(52) U.S. Cl.

USPC ..... 235/379; 235/375

(58) Field of Classification Search

USPC ..... 235/379, 375; 902/8, 13–21

See application file for complete search history.

(56) References Cited

U.S. PATENT DOCUMENTS

| | | | | |
|---|---|---|---|---|
| 8,396,278 | B2 * | 3/2013 | Jones et al. | 382/135 |
| 2009/0087076 | A1 * | 4/2009 | Jenrick et al. | 382/135 |

* cited by examiner

*Primary Examiner* — Edwyn Labaze

(74) *Attorney, Agent, or Firm* — Paul W. Martin

(57) ABSTRACT

An apparatus and method are disclosed for determining an empty condition in an item of media container. The apparatus includes a plate member, comprising a reflective region, that moves towards an empty position as items of media are dispensed from a container, and a mask element which is locatable in a first position as items of media are dispensed, and a further position when the container is empty. An empty condition of the container is determined responsive to the mask element being located in the further position.

19 Claims, 6 Drawing Sheets

FIG. 5
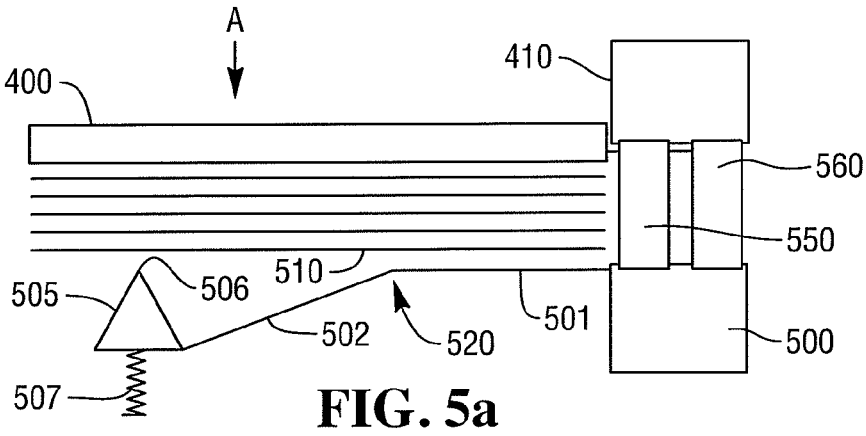
FIG. 5a
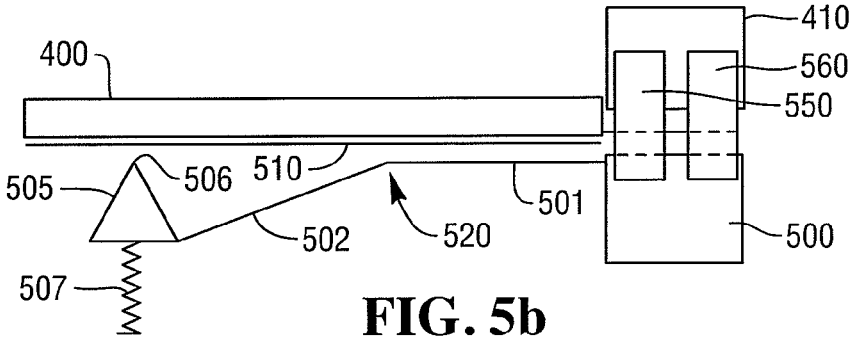
FIG. 5b
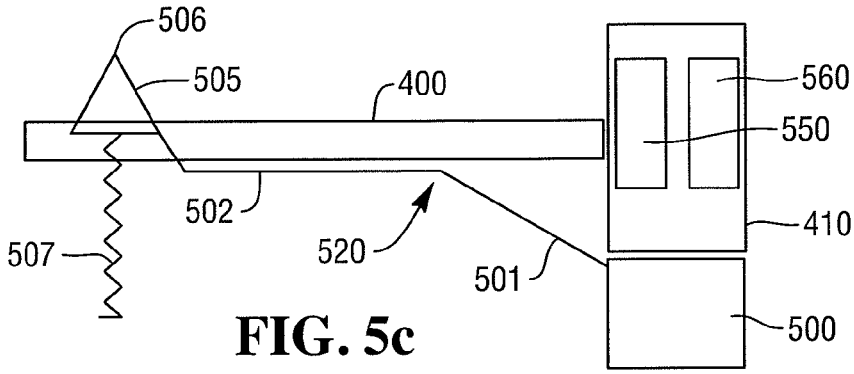
FIG. 5c

STATE DETECTION

FIELD OF THE INVENTION

The present invention relates to a method and apparatus for determining a condition in an item of media container. In particular, but not exclusively, the present invention relates to apparatus for determining when a media container is close to becoming empty and thereafter when it becomes empty.

BACKGROUND TO THE INVENTION

It is known that various types of container can be used to contain items of media. For example, a cassette or depository can be utilized to store flexible items of media such as, but not limited to, currency notes, checks, sheets of stamps, prepayment cards, tickets, giros and the like.

Such media containers are often used in self-service terminals such as automatic teller machines (ATMs), vending machines, retail product dispensers and the like.

In such machines, it is important that when an item of media is to be removed from the container in which it is held, the item of media is removed without error. A particular problem with such removal is that it is often difficult to remove one item of media from a pick up region of a container without upsetting the next item of media within the container or without risking the removal of multiple items together.

In such machines, it is also important to establish that there are items of media still to be dispensed. It is helpful to receive an indication when a container is becoming empty so that a signal can be sent to a third party to begin to arrange for replenishment of the dispenser. This signal may be sent to another location on site where the media dispenser is located or remotely with authorized personnel thereafter being dispatched with new items of media to the location of the media dispenser.

It is also a frequent requirement for media handling devices to know when storage areas are empty as well as low, be it for deposit, recycle or dispense. Solutions have been proposed including the use of an infrared emitter and receiver which determines when a pusher plate or other moving part reaches a point corresponding to a container being empty. However, prior art solutions are prone to error and have been found to incorrectly flag an empty situation when in fact items of media remain. Alternatively multiple sensors and detectors have been needed which is costly to manufacture and prone to error.

SUMMARY OF THE INVENTION

It is an aim of the present invention to at least partly mitigate the above-mentioned problems.

It is an aim of certain embodiments of the present invention to provide an apparatus and method for determining an empty condition in an item of media container.

It is an aim of certain embodiments of the present invention to provide a method and apparatus able to determine when a container is becoming empty and also when the container thereafter actually becomes empty utilizing the same pieces of equipment.

It is an aim of certain embodiments of the present invention to provide a reliable indication as to when a container is becoming empty and thereafter actually becomes empty.

According to a first aspect of the present invention, there is provided apparatus for determining an empty condition in an item of media container, comprising:

a plate member, comprising a reflective region, that moves towards an empty position as items of media are dispensed from a container; and a mask element, locatable in a first position as items of media are dispensed and a further position when the container is empty; wherein an empty condition of the container is determined responsive to the mask element being located in the further position.

Aptly, in the first position, the mask element masks a portion of the reflective region as the plate member moves towards the empty position and in the further position, the mask element does not mask any of the reflective region.

Aptly, the apparatus further includes an abutment member biased towards the plate member that locates through an opening in the plate member when the plate member moves to the empty position; and a pivot arm comprising the abutment member at a first end thereof and the mask element at a further end thereof; wherein location of the abutment member in the opening pivots the pivot arm about a pivot point to thereby move the mask element from the first position to the further position.

Aptly, the apparatus further includes at least one electromagnetic radiation detector that detects electromagnetic radiation reflected from the reflective region.

Aptly, the apparatus further includes at least one electromagnetic radiation source that illuminates the reflective region as the plate member moves towards the empty position.

Aptly, the electromagnetic radiation is infrared radiation.

Aptly, the plate member is a pusher plate that is biased by at least one biasing element towards the mask element when the mask element is in the first position, to thereby urge items of media stacked in the container into a dispense position one-by-one.

Aptly, the detector detects a gradual increase in reflected radiation as the reflective region moves to a position where it is masked, a substantially steady state whilst the reflective region is masked, and an abrupt increase in reflected radiation when the mask element is located in the further position.

Aptly, the reflective surface is worked to increase the reflectivity to a sensing wavelength range relative to the inherent reflective properties of the plate member. Aptly, the plate member carries a reflective piece to increase reflectivity.

Optionally, the mask element comprises a high absorption material selected to absorb radiation emitted from the radiation source.

According to a second aspect of the present invention, there is provided an automated teller machine (ATM) comprising apparatus for determining an empty condition in an item of media container, comprising:

a plate member, comprising a reflective region, that moves towards an empty position as items of media are dispensed from a container; and a mask element, locatable in a first position as items of media are dispensed and a further position when the container is empty; wherein an empty condition of the container is determined responsive to the mask element being located in the further position and the items of media are currency notes.

According to a third aspect of the present invention, there is provided a method of determining an empty condition in an item of media container, comprising the steps of:

urging a plate member comprising a reflective region towards an empty position as items of media are dispensed from a container;

locating a mask element in a first position as items of media are dispensed, and in a further position when the container is empty; and determining that the container is empty responsive to the mask element being located in the further position.

Aptly, the method further includes, in the first position, masking a portion of the reflective region with the mask element as the plate member moves towards the empty position; and in the further position, not masking any of the reflective region with the mask element.

Aptly, the method further includes dispensing items of media from the container one-by-one until the container is empty.

Aptly, the method further includes biasing an abutment member towards the plate member whilst items of media are dispensed;

when a final item of media is dispensed, locating the abutment member through an opening in the plate member;

pivoting a pivot arm comprising the abutment member at a first end thereof about a pivot point when the abutment member is located through the opening; and moving the mask element at a further end of the pivot arm from the first position to the further position when the pivot arm pivots.

Aptly, the method further includes detecting electromagnetic radiation reflected by the reflective region as the plate member moves to the empty position.

According to a fourth aspect of the present invention, there is provided apparatus for determining a condition of a container, comprising:

a reflective element that moves with a final item to be dispensed from a container; and a mask element that masks at least a part of the reflective element as a number of items in the container drops to a first predetermined threshold value and is prevented from masking the reflective element when the number of items in the container drops to a second predetermined threshold value; wherein a condition of the container is determined responsive to a revealed area of the reflective element.

Certain embodiments of the present provide the advantage that as a pusher plate moves with items of media towards an empty position the appearance of the pusher plate is detected and utilized to indicate that a container is becoming empty. The same detection system is thereafter utilized to determine an empty condition when the pusher plate is moved into an empty position after a final item of media is picked for subsequent dispensation to a user.

Certain embodiments of the present invention provide a method and apparatus for determining an empty condition in an item of media container whereby false positives are avoided.

BRIEF DESCRIPTION OF DRAWINGS

Embodiments of the present invention will now be described hereinafter, by way of example only, with reference to the accompanying drawings in which:

FIG. 5 illustrates the masking and unmasking of a reflective surface of a pusher plate as items of media are dispensed.

DESCRIPTION OF EMBODIMENTS

Figure 1:
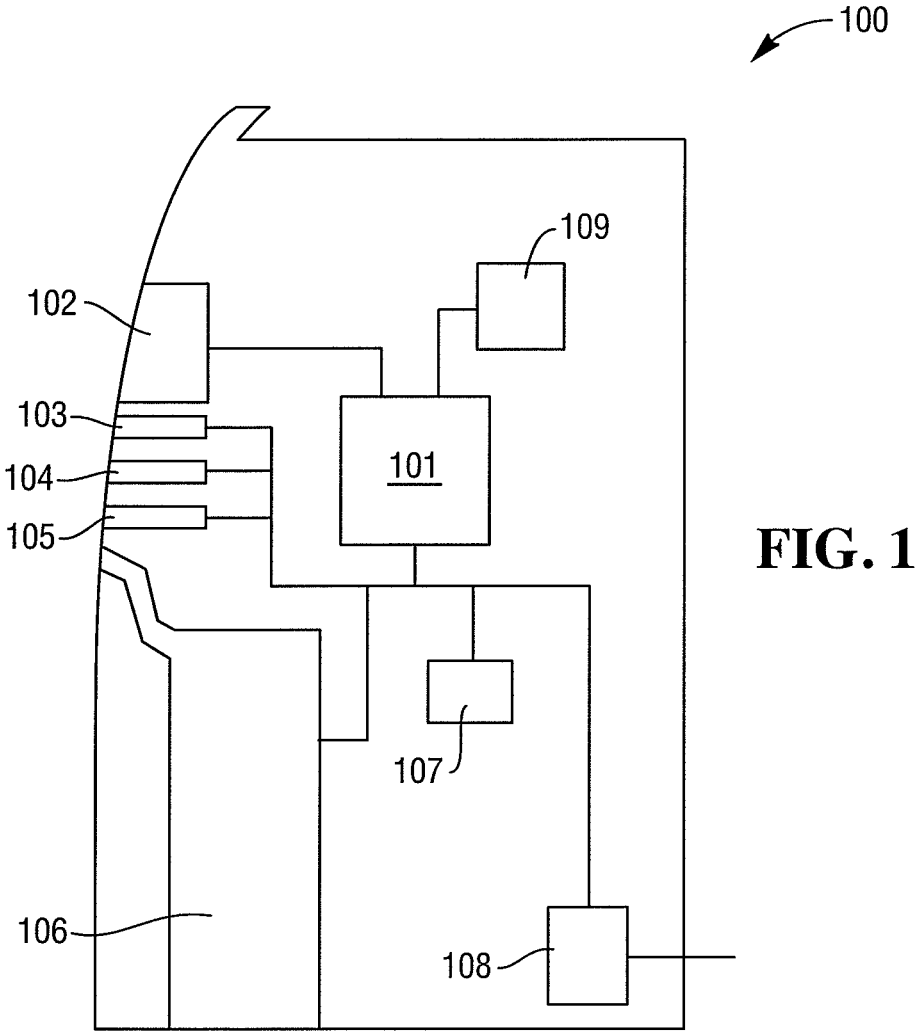
FIG. 1 illustrates a schematic diagram of a self-service terminal according to an embodiment of the present invention.

In the drawings like reference numerals refer to like parts.

FIG. 1 illustrates a block diagram of a self-service terminal 100 in the form of an automated teller machine (ATM) according to one embodiment of the present invention. It will be understood that certain embodiments of the present invention are applicable to other types of terminal such as ATMs, vending machines, stamp dispensers, prepayment card dispensers and the like.

The ATM 100 includes different modules for enabling transactions to be executed and recorded by the ATM 100. These ATM modules include customer transaction modules and service personnel modules. The ATM modules include an ATM controller 101, a customer display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by a service operator (such as a field engineer, a replenisher (of currency, of printed paper or the like), or the like).

Certain customer transaction modules (such as the ATM controller 101) are also used by the service personnel for implementing management functions. However, some of the modules are referred to herein as service personnel modules (such as the journal printer module 107 and the operator panel module 109) because they are never used by ATM customers.

Figure 2:
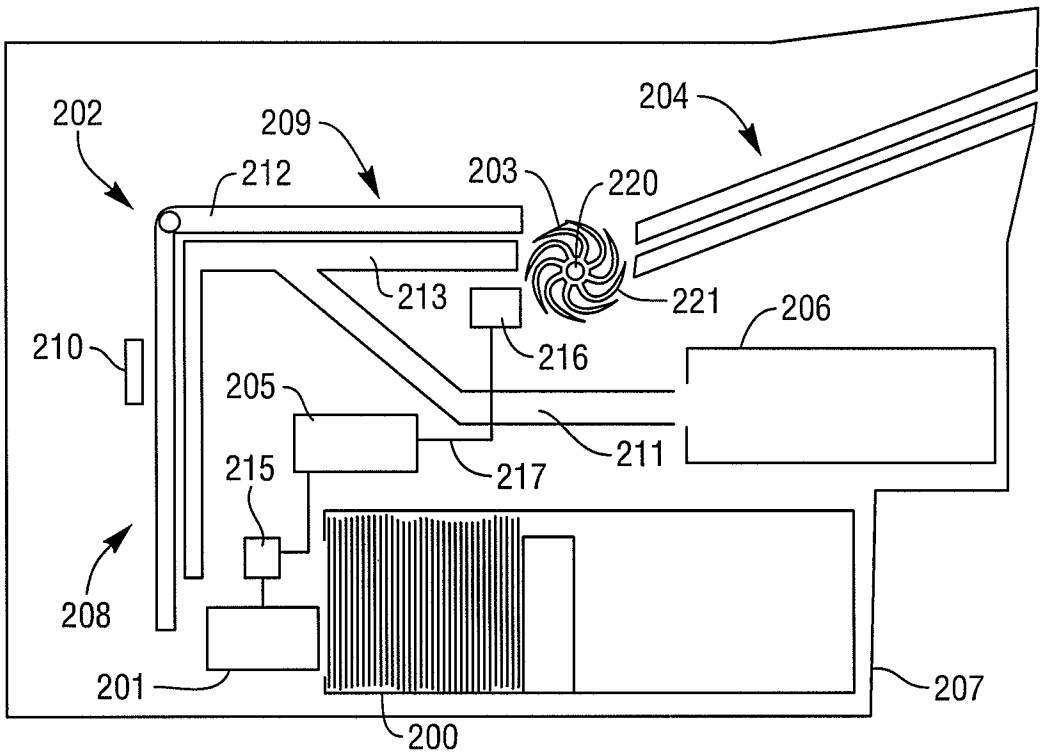
FIG. 2 illustrates a schematic diagram of a media dispenser in the self-service terminal.

FIG. 2 illustrates a schematic diagram of an ATM media dispenser 100. The ATM 100 includes a removable currency cassette 200, a pick unit 201 which operates to remove individual currency notes from the currency cassette 200, a transport section 202 for transporting picked currency notes, a stacker wheel 203 (instead of a stacker wheel a ballistic stacker or a spray dispenser or the like could be used). A presenter unit 204 presents a bunch of picked and collated currency notes to a customer. A controller 205 controls the operation of the dispenser 100 and a purge bin 206 stores incorrectly picked currency notes or currency notes not removed by a customer. These component parts are housed within a chassis 207.

The transport section 202 includes a vertical portion 208 for receiving a picked currency note from the pick unit 201 and a horizontal portion 209 for conveying a picked currency note either to the stacker wheel 203 or the purge bin 206. The vertical portion 208 includes a conventional currency note thickness sensor 210 to detect multiple superimposed currency notes being transported erroneously as a single currency note. Any such superimposed currency notes may have to be diverted to the purge bin 206 via a divert path 211. The horizontal portion 209 comprises an upper guide 212 which is pivotably coupled to a lower guide 213 to permit access to any currency notes jammed therebetween so that the jammed currency note can be removed therefrom. The lower guide 213 includes a diverter (not shown) for routing a currency note (or multiple currency notes) to the divert path 211.

The transport section includes various belts and/or gears to transport currency notes or other such currency notes and these belts and/or gears are all powered by a pick motor 215.

The stacker wheel 203 is coupled to a stacker wheel motor 216. The stacker wheel motor 216 is coupled to the controller 205 by a control line 217.

Figure 3:
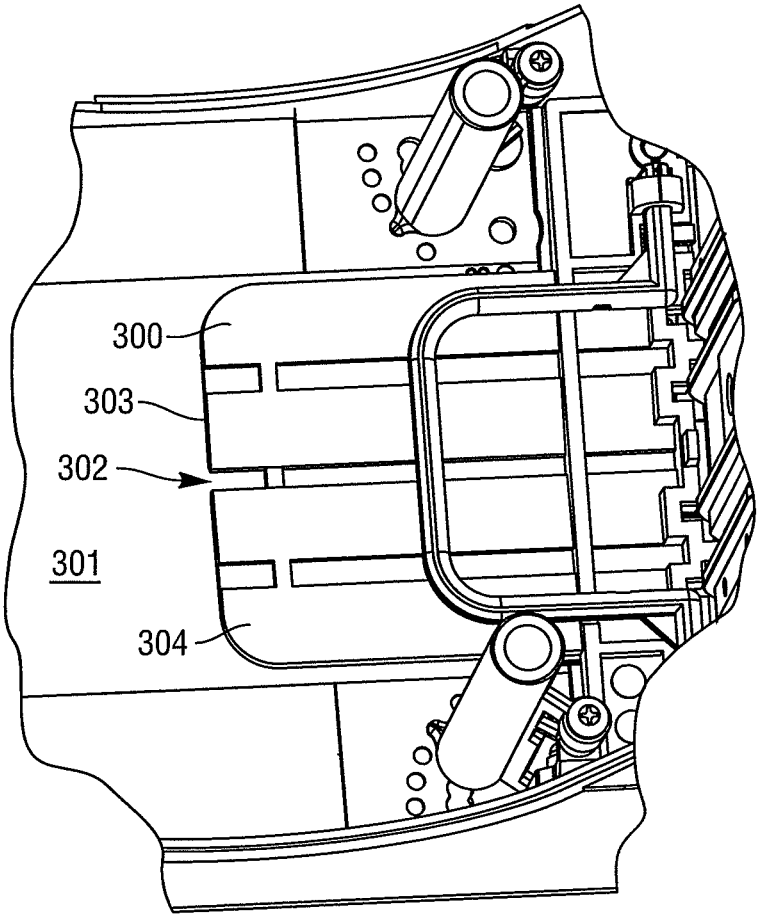
FIG. 3 illustrates how a pusher plate pushes on a stack of currency notes.

FIG. 3 illustrates how a pusher plate 300 inside a currency cassette 200 pushes against an upper surface of a currency note 301 in a stack of currency notes. As illustrated in FIG. 3, the pusher plate 300 includes a rigid plate which is a substantially plate-like member. A cut out section 302 at an edge 303 of the plate provides an opening in the plate member. The rigid plate 304 thus moves vertically within the cassette dependent upon a number of notes present in the dispenser. In FIG. 3, only one currency note 301 is shown. It will be appreciated that in use, a stack of currency notes are located in the currency cassette 200 with currency notes laid in the stack one on top of another in an aligned fashion. The pusher plate 300 pushes from an upper region inside the currency cassette. The pusher plate 300 pushes the stack downwards and towards a dispensing point where a next-to-be-picked currency note may be picked. When the final currency note in a stack is picked, then the currency cassette becomes empty. As noted above, it is often helpful to be able to determine when a currency cassette is almost empty. It is also helpful to be able to determine when a currency cassette is empty. Aptly, a currency cassette is almost empty when twenty or less currency notes are stacked in the currency cassette. Aptly, the currency cassette is deemed to be almost empty when forty or less currency notes are stacked in the currency cassette. Aptly, the currency cassette is deemed almost empty when ten or less currency notes are in the stack.

Figure 4:
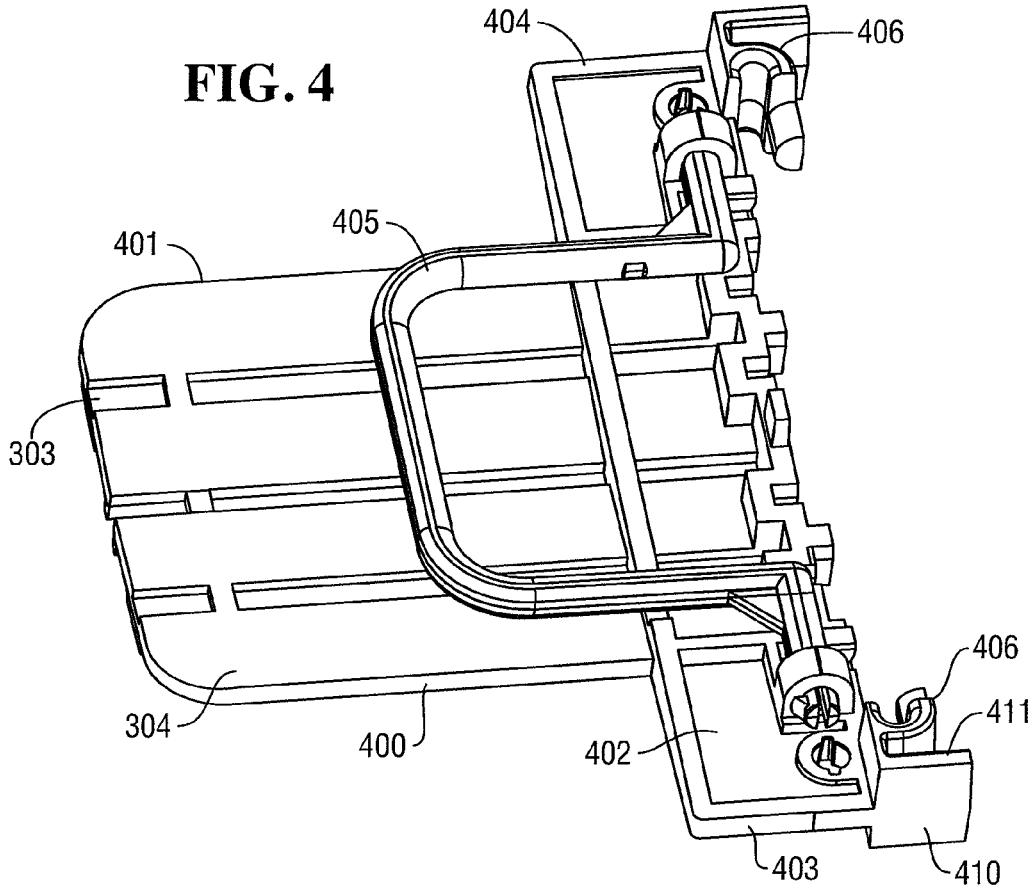
FIG. 4 illustrates a pusher plate with a handle and guide grooves.

FIG. 4 illustrates a pusher plate assembly which moves as a stack of currency notes is denuded from the currency cassette. The pusher plate includes the plate-like, substantially rectangular section 304 which has substantially parallel, spaced apart sides 400, 401. A cut-out section 302 or other such through hole is formed at an edge 303. A pusher support 402 which is substantially rectangular and which includes spaced apart, substantially parallel edges 403, 404, helps support the plate 301 and a handle 405 is pivotably mounted so that when a user comes to replenish a stack of currency notes, they can lift the handle and pull the pusher plate away from the dispensing end of the currency cassette.

A locating guide 406 is located at each end of the rectangular portion 402 of the pusher plate assembly. The guides 406 help retain the pusher plate in a predetermined orientation inside the currency cassette and may optionally ride along rods within the currency cassette to thereby keep the pusher plate assembly in a fixed and desired orientation as it moves vertically within the cassette pushing currency notes stacked therein towards a dispensing location.

A highly reflective surface 410 is provided by an extension plate 411 of the pusher plate assembly. Aptly, apart from the handle, the parts of the pusher plate assembly are integrally formed. As will be described hereinbelow in more detail the highly reflective surface 410 is highly reflective to a form of electromagnetic radiation utilized for a sensing operation. Aptly, the surface may be highly polished so as to reflect visible or infrared radiation. Aptly, the reflective surface is provided by treatment of the surface (such as by polishing) of the integral material utilized to manufacture the pusher plate assembly. Optionally, the plate 411 may itself be provided of a material which inherently is reflective to a source of radiation and the plate itself affixed/secured to the pusher plate assembly.

FIG. 5 illustrates the location of the pusher plate and reflective surface 410 in three positions. More particularly, FIG. 5*a* illustrates the pusher plate as the stack of currency notes approaches an almost empty state. FIG. 5*b* illustrates the pusher plate location with only one currency note left in the currency cassette. FIG. 5*c* illustrates the location of the pusher plate when a final currency note in the currency cassette has been picked and thus the currency cassette is empty. Each of the figures in FIG. 5 illustrates a side on view of the currency note pusher plate. That is to say, a side view of the edge 400 of the pusher plate is schematically illustrated together with the reflective surface 410.

Also illustrated in FIG. 5 is a mask 500 which is a substantially plate-like cover which when in place covers part or parts or the whole of the reflective region 410 of the pusher plate. The mask 500 is connected via a connector which is bent at an intermediate region. Thus, a first region 501 of the connector turns into a further region 502 of the connector. At a further end of the second region of the connector is a triangular shaped pin 505 which has an abutment tip 506. The pin 505 and thus the tip 506 are constantly urged upwardly by a spring 507 or other such biasing element. The abutment tip 506 is thus urged against a lower surface 510 of a next to be picked currency note in the currency stack. The pin 505 and connector and mask 500 are arranged to pivot about a pivot point 520. Thus, when at least one currency note is in the currency stack, the abutment tip 506 is prevented from moving upwardly because it abuts with the currency note which is urged downwardly by the pusher plate. The mask 500 thus remains in a constant location as currency notes are dispensed.

Initially, when a large stack of currency notes are located in the currency cassette, the reflective surface 410 of the pusher plate is far away from the location of the mask. A source 550 of electromagnetic radiation is located so that radiation falls in the region where the reflective surface will be located when a currency cassette is almost empty and actually empty. Thus, when a stack of currency notes is fully loaded and the reflective surface is a long way away from the mask, little reflected radiation is detected by a suitably located detector 560. Aptly, the source and detector are an infrared (IR) source and detector. Aptly, the source and detector are a visible light source and detector. Aptly, the source provides radiation at about around a source wavelength which is about around an optimal sense wavelength associated with the detector. Aptly, the source wavelength is about around 850 nm. Aptly, the sensor optimal sense wavelength is about around 850 nm.

As the currency notes are picked, the pusher plate pushes the stack towards the dispensing point in the direction of arrow A in FIG. 5*a* and gradually the pusher plate and reflective surface will move towards the triangular pin 505. It will be appreciated that the pin and tip might have many different possible configurations. Eventually, in an almost empty condition, the pusher plate and the associated reflective region 410 will move towards the mask as shown in FIG. 5*a*. At this moment in time, reflected radiation will become detected by the suitably located detector 560. An increase in a voltage beyond a predetermined value can thus be utilized to determine that the currency cassette is in an almost empty state. Thereafter, as currency notes are picked the reflective region 410 moves further downwardly in the direction of arrow A shown in FIG. 5*a*. However, because of the location of the mask, greater detected reflective values are not identified. This helps prevent swamping of the detected voltage signal.

As the currency notes in the stack are used up, a condition arises whereby a final currency note is available to be picked. This is shown in FIG. 5*b*. At this stage, a large portion of the reflective region 410 is hidden by the mask, however, sufficient reflective surface remains evident so that the detected voltage level is maintained at about a constant value. The detected voltage from the detector has thus remained approximately steady at around a fixed voltage. Aptly, the fixed voltage is around 2.5 volts. Eventually, a final currency note in the currency cassette is picked. This is illustrated in FIG. 5*c*. When this occurs, the tip 506 of the pin 505 is no longer prevented from moving upwardly by a currency note pushed by the pusher plate. Also, the position of the pin 505 corresponds to the cut out section 302 located in the pusher plate. It will be appreciated that whilst the cut out section 302 is shown in FIGS. 3 and 4 as being at an edge of the pusher plate, there is no reason why the through hole could not be located at another location, nor indeed why the through hole needs to be a through hole, but could instead be a groove or other such indented region. It is sufficient that some extra movement of the pin is permitted when the cassette empties and that this movement triggers the whole or partial masking effect. The net effect with a through hole, however, is that the tip 506 once a final currency note has been picked, is enabled to move upwardly in relation to the direction shown in FIG. 5. As this end of the pin and connector moves upwardly the pivoting action around the pivot point 520 causes the mask to move away from the position of the reflective zone 410 of the pusher plate. Thus, a greater region of the reflective zone is revealed and causes a far higher degree of reflection and thus a far greater voltage to be determined by the detector. Aptly, the voltage detected when the mask moves away from the reflective zone is 5 volts. This step change is detected or the higher voltage is detected and used to indicate a cassette empty condition.

Figure 6:
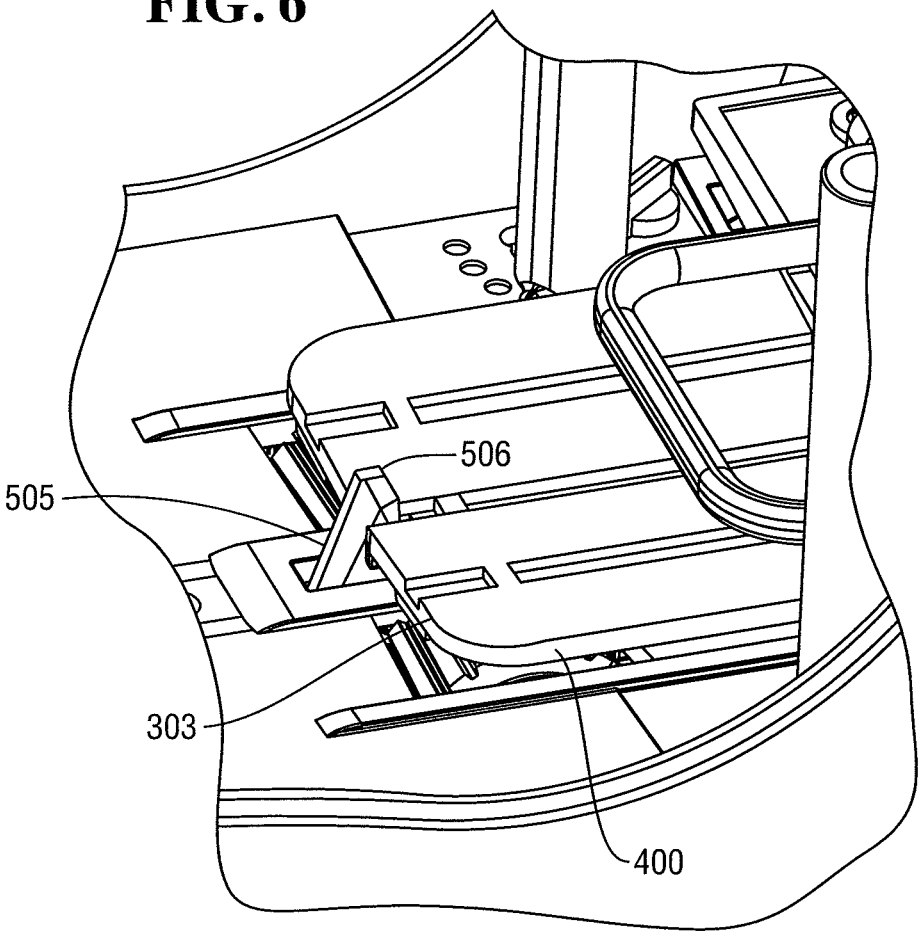
FIG. 6 illustrates a pusher plate in an empty position in which an abutment tip of a pin has moved to protrude through an opening in the plate member.

FIG. 6 illustrates the pusher plate in an empty cassette condition in which the shark's fin or triangular shaped pin 505 and associated tip 506 move to protrude through the cut out section 302 in the pusher plate.

Thus, according to certain embodiments of the present invention, one sensor and a shark fin arrangement are utilized to get a definite note out condition signal. The shark fin pin and mask arrangement cover a reflective surface by around about fifty percent so that sensing can be carried out down to ten or fifteen notes or less. When a last note is removed the shark fin pin cantilevers and reveals the remaining reflective material which provides a hard increased voltage signal. Thus, the same sensor can be utilized for both low cassette content conditions and give a confirmed cassette empty signal. The use of one source and sensor helps reduce the cost of production in parts and harnessing and reduces a number of apertures in the cassette which may be utilized to allow penetration of electromagnetic radiation from the source into the cassette from the external housing and allow reflected radiation to be emitted from within the cassette to a detector which optionally may also be external to the cassette.

Another advantage associated with certain embodiments of the present invention is that a need for apertures or through holes in the housing of the currency cassette is substantially reduced relative to the prior art techniques that use multiple sensors and detectors. This allows for greater security as thieves would otherwise try to pick or wind out media items via such openings.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for determining an empty condition in an item of media container, comprising:

a plate member, comprising a reflective region, that moves towards an empty position as items of media are dispensed from a container; and a mask element, locatable in a first position as items of media are dispensed and a further position when the container is empty; wherein an empty condition of the container is determined responsive to the mask element being located in the further position.

2. The apparatus as claimed in claim 1, further comprising:

in the first position, the mask element masks a portion of the reflective region as the plate member moves towards the empty position and in the further position, the mask element does not mask any of the reflective region.

3. The apparatus as claimed in claim 2, further comprising:

an abutment member biased towards the plate member that locates through an opening in the plate member when the plate member moves to the empty position; and a pivot arm comprising the abutment member at a first end thereof and the mask element at a further end thereof;

wherein location of the abutment member in the opening pivots the pivot arm about a pivot point to thereby move the mask element from the first position to the further position.

4. The apparatus as claimed in claim 1, further comprising:

at least one electromagnetic radiation detector that detects electromagnetic radiation reflected from the reflective region.

5. The apparatus as claimed in claim 4, further comprising:

at least one electromagnetic radiation source that illuminates the reflective region as the plate member moves towards the empty position.

6. The apparatus as claimed in claim 5, wherein the electromagnetic radiation is infrared radiation.

7. The apparatus as claimed in claim 1, further comprising:

the plate member is a pusher plate that is biased by at least one biasing element towards the mask element when the mask element is in the first position, to thereby urge items of media stacked in the container into a dispense position one-by-one.

8. The apparatus as claimed in claim 6, further comprising:

the detector detects a gradual increase in reflected radiation as the reflective region moves to a position where it is masked, a substantially steady state whilst the reflective region is masked, and an abrupt increase in reflected radiation when the mask element is located in the further position.

9. An automated teller machine (ATM) comprising the apparatus as claimed in claim 1, wherein the items of media are currency notes.

10. A method of determining an empty condition in an item of media container, comprising the steps of:

urging a plate member comprising a reflective region towards an empty position as items of media are dispensed from a container;

locating a mask element in a first position as items of media are dispensed, and in a further position when the container is empty; and determining that the container is empty responsive to the mask element being located in the further position.

11. The method as claimed in claim 10, further comprising:

in the first position, masking a portion of the reflective region with the mask element as the plate member moves towards the empty position; and in the further position, not masking any of the reflective region with the mask element.

12. The method as claimed in claim 10, further comprising:

dispensing items of media from the container one-by-one until the container is empty.

13. The method as claimed in claim 10, further comprising:

biasing an abutment member towards the plate member whilst items of media are dispensed;

when a final item of media is dispensed, locating the abutment member through an opening in the plate member;

pivoting a pivot arm comprising the abutment member at a first end thereof about a pivot point when the abutment member is located through the opening; and moving the mask element at a further end of the pivot arm from the first position to the further position when the pivot arm pivots.

14. The method as claimed in claim 10, further comprising:

detecting electromagnetic radiation reflected by the reflective region as the plate member moves to the empty position.

15. Apparatus for determining a condition of a container, comprising:

a reflective element that moves with a final item to be dispensed from a container; and a mask element that masks at least a part of the reflective element as a number of items in the container drops to a first predetermined threshold value and is prevented from masking the reflective element when the number of items in the container drops to a second predetermined threshold value; wherein a condition of the container is determined responsive to a revealed area of the reflective element.

16. Apparatus for determining an empty condition in an item of media container, comprising:

a plate member, comprising a reflective region, that moves towards an empty position as items of media are dispensed from a container; and a mask element, locatable in a first position as items of media are dispensed and a further position when the container is empty;

wherein an empty condition of the container is determined responsive to the mask element being located in the further position;

wherein, in the first position, the mask element masks a portion of the reflective region as the plate member moves towards the empty position and in the further position, the mask element does not mask any of the reflective region;

an abutment member biased towards the plate member that locates through an opening in the plate member when the plate member moves to the empty position; and a pivot arm comprising the abutment member at a first end thereof and the mask element at a further end thereof;

wherein location of the abutment member in the opening pivots the pivot arm about a pivot point to thereby move the mask element from the first position to the further position.

17. Apparatus for determining an empty condition in an item of media container, comprising:

a plate member, comprising a reflective region, that moves towards an empty position as items of media are dispensed from a container;

a mask element, locatable in a first position as items of media are dispensed and a further position when the container is empty; wherein an empty condition of the container is determined responsive to the mask element being located in the further position; and at least one electromagnetic radiation detector that detects electromagnetic radiation reflected from the reflective region.

18. A method of determining an empty condition in an item of media container, comprising the steps of:

urging a plate member comprising a reflective region towards an empty position as items of media are dispensed from a container;

locating a mask element in a first position as items of media are dispensed, and in a further position when the container is empty;

determining that the container is empty responsive to the mask element being located in the further position;

biasing an abutment member towards the plate member whilst items of media are dispensed;

when a final item of media is dispensed, locating the abutment member through an opening in the plate member;

pivoting a pivot arm comprising the abutment member at a first end thereof about a pivot point when the abutment member is located through the opening; and moving the mask element at a further end of the pivot arm from the first position to the further position when the pivot arm pivots.

19. A method of determining an empty condition in an item of media container, comprising the steps of:

urging a plate member comprising a reflective region towards an empty position as items of media are dispensed from a container;

locating a mask element in a first position as items of media are dispensed, and in a further position when the container is empty;

determining that the container is empty responsive to the mask element being located in the further position; and detecting electromagnetic radiation reflected by the reflective region as the plate member moves to the empty position.

* * * * *